United States Patent [19]

Pickett

[11] 4,393,614

[45] Jul. 19, 1983

[54] GUN REST

[76] Inventor: Fred E. Pickett, 508 Sophia La., Shreveport, La. 71115

[21] Appl. No.: 238,763

[22] Filed: Feb. 27, 1981

Related U.S. Application Data

[63] Continuation-in-part of Ser. No. 158,060, Jun. 9, 1980, Pat. No. 4,345,398.

[51] Int. Cl.[3] ..... F41C 29/00

[52] U.S. Cl. ..... 42/94

[58] Field of Search ..... 42/94; 89/37 BA

[56] References Cited

U.S. PATENT DOCUMENTS

| | | | |
|---|---|---|---|
| 879,052 | 2/1908 | Jeranek | 42/94 |
| 1,112,732 | 10/1914 | Uhl | 42/94 |
| 1,890,423 | 12/1932 | Teagarden | 42/94 |
| 3,007,581 | 11/1961 | Moore | 42/94 |
| 4,017,997 | 4/1977 | Peterson et al. | 42/94 |

*Primary Examiner*—Charles T. Jordan

*Attorney, Agent, or Firm*—John M. Harrison

[57] ABSTRACT

A gun rest for firearms which is characterized by a monopod having a base tube or cylinder and a plurality of nesting, tapered interior tubes or cylinders, each having a successively smaller diameter and arranged in a concentric, normally retracted, telescoping configuration inside the base tube. A monopod clamp is removably attached to the firearm barrel forward of the forestock, and pivotally carries the closed end of the base tube to secure the base tube to the barrel. When not in use the monopod is positioned in an essentially parallel, retracted relationship to, and beneath the barrel of the firearm. In its functional position the monopod is pivoted on the monopod clamp in an essentially perpendicular relationship to the firearm barrel, with the interior tubes or cylinders selectively and telescopically extended from the base tube and temporarily locked to provide a secure rest for aiming and shooting the firearm.

8 Claims, 10 Drawing Figures

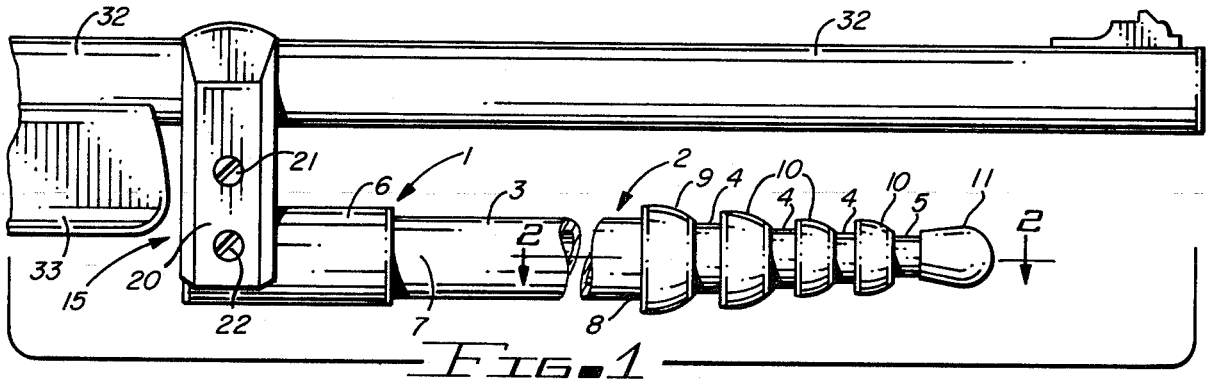
FIG. 1
FIG. 2
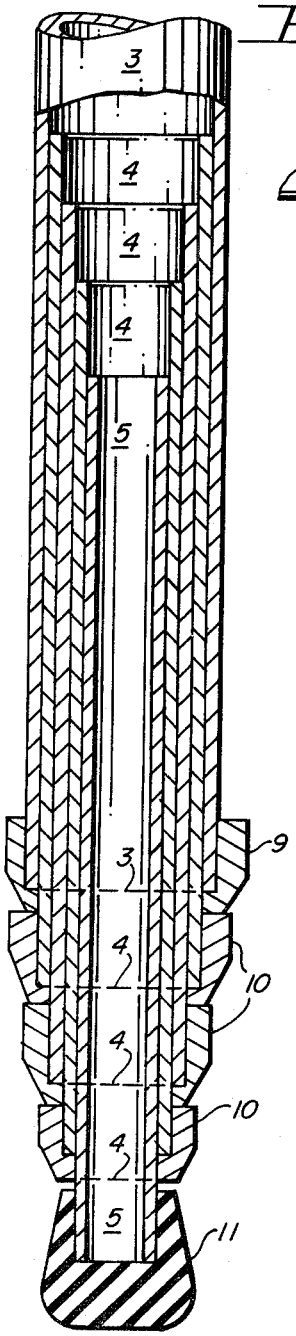
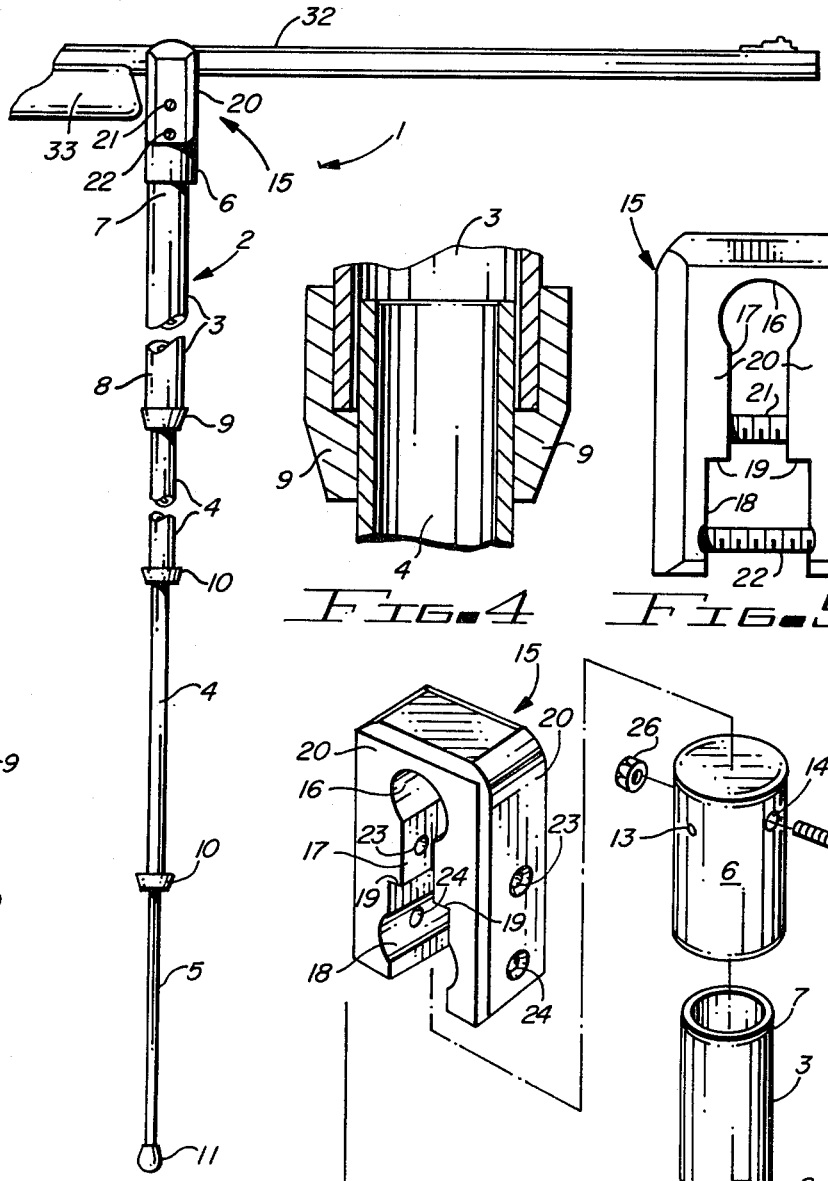
FIG. 3
FIG. 4
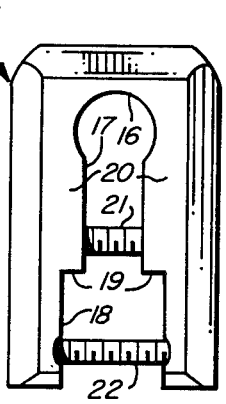
FIG. 5
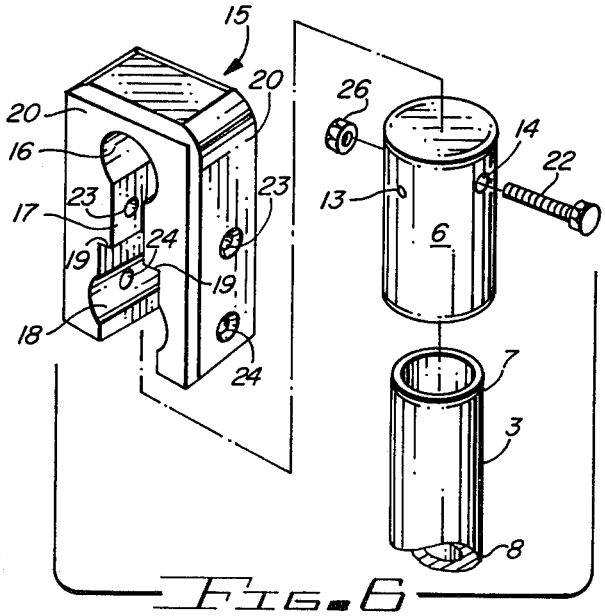
FIG. 6

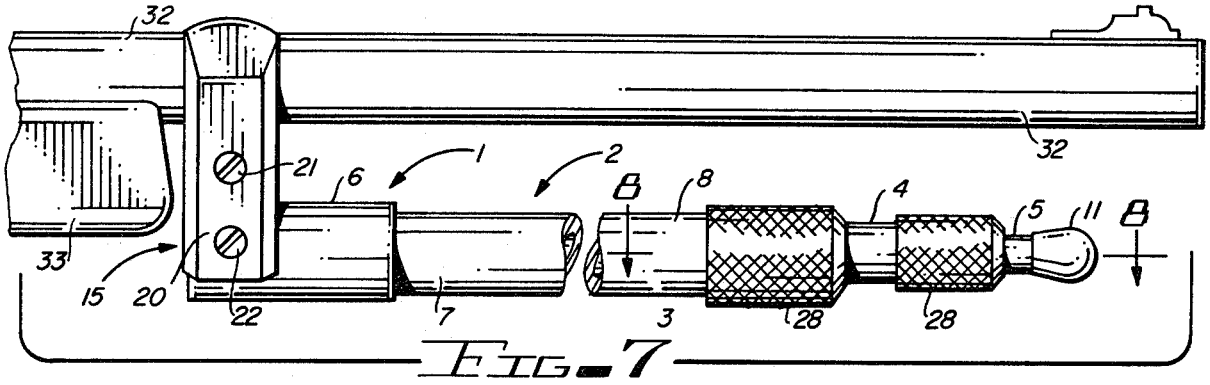
FIG. 7
FIG. 8
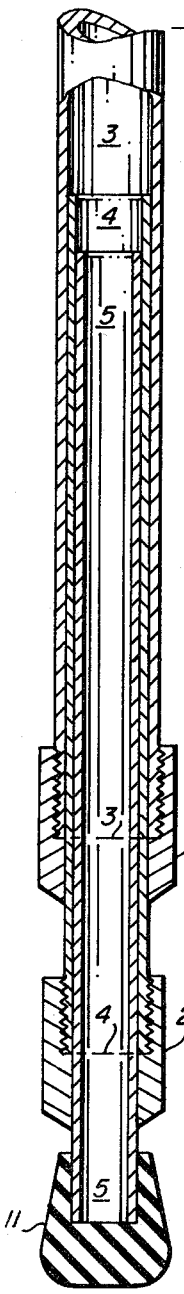
FIG. 10
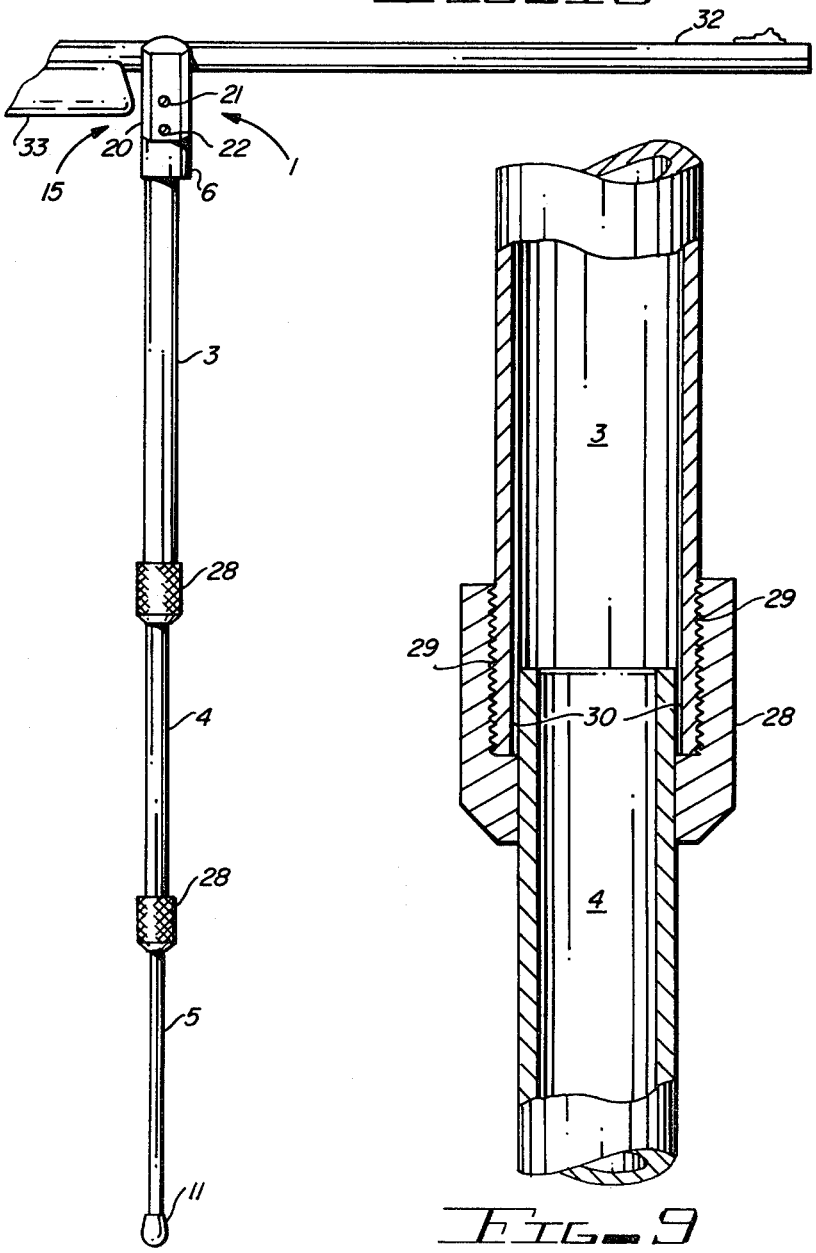
FIG. 9

GUN REST

CROSS REFERENCE TO RELATED APPLICATIONS

This application is a Continuation-in-Part of my copending application serial number 06/158,060, filed June 9, 1980, now Pat. No. 4,345,398.

BACKGROUND OF THE INVENTION

1. Field of the Invention

This invention relates to gun rests for firearms, and more particularly, to a gun rest which is normally carried in a folded, retracted and telescoping configuration beneath the barrel of a gun or rifle, and which can be quickly and selectively extended to provide a secure rest for aiming the gun or rifle at a selected elevation. The gun rest of this invention is light in weight, compact, normally aligned with and positioned beneath the rifle barrel when not in use, and is capable of quick and easy pivotal and locked extension to provide a functional rest of selected length with minimum effort. In preferred embodiments of the invention the concentrically positioned, telescoping tubes and cylinders are provided with grommets and compression fittings, respectively, to effectively lock the tubes and cylinders in the extended configuration, and to facilitate return to the retracted position when it is desired to restore the monopod to its non-functional, folded configuration.

2. Description of the Prior Art

Gun rests of varying description and design have been in existence since the advent of firearms. Perhaps the earliest known rest was a forked stick of selected length used to support the barrel of a gun while aiming and firing. Such rests were known in the Revolutionary War and were, in many instances, considered to be essential equipment for sharp-shooters and snipers that era. Gun rests were particularly significant and useful during this time period because of the extremely heavy weight which characterized the guns and muskets used, which bulk necessitated either a portable rest, or the use of a tree or fence post to support the barrel of the weapon. Typical of the gun rests of an early era is that described in British Pat. No. 15,996 to E. C. Abella, which discloses a gun support having one end hingedly attached to a rifle or gun at a point forward of the trigger guard, and the opposite end secured to the user's belt. The device was designed to telescope and cradle the gun in order to facilitate a steady aim and greater accuracy.

Bipod support attachments for weapons are particularly well known in the art. Typical of such supports is the bipod gun mount for military application which is disclosed in U.S. Pat. No. 3,235,997 to E. M. Stoner, which device includes a spring-loaded, folding and adjustable bipod mount positioned on the front end of a firearm for support in aiming and firing the weapon. Another bipod mount is disclosed in U.S. Pat. No. 3,327,422 to G. Harris, which device is adapted for attachment to a firearm, and includes a chair having a pivoting seat and back, and mounted on a base to swing forwardly and upwardly. A link system supported by the seat is provided with a leg rest on the front end, which is disposed beneath the seat when retracted and in parallel relation therewith and with itself, in all positions during movement from retracted to extended configuration.

Most of the gun rests or mounts disclosed in the prior art were designed for military application, with the bipod mounts having specific application to relatively heavy, automatic or semi-automatic weapons which were designed to be fired while in the prone position. These mounts are characteristically heavy and cumbersome and are generally adjustable only to a limited degree.

Accordingly, it is an object of this invention to provide a new and improved monopod rest for firearms which is adjustable and light in weight, and which may be removably and pivotally mounted on the barrel of substantially any gun or rifle for quick and easy deployment from a compact and convenient stored configuration.

Another object of this invention is to provide a new and improved monopod gun rest for substantially any firearm which is characterized by a plurality of light, nested and tapered telescoping members which are biased in a normally retracted configuration, and which may be removably and rotatably clamped to the barrel of a firearm for selective, pivotal, downward extension and locking to provide a stedy, efficient and secure rest during aiming and firing of the gun or rifle, and to permit rotation of the gun or rifle barrel in the barrel clamp or clamps when the weapon is sighted on a moving target.

Yet another object of the invention is to provide a monopod firearm rest which includes a plurality of light, telescoping cylinders which can be biased in an extended configuration by means of compression fittings, the monopod mounted in pivotal relationship to the barrel of the firearm by means of a removable clamp.

Yet another object of this invention is to provide a new and improved, light-weight gun rest which can be removably mounted on the barrels of guns and rifles of substantially any description, which rest is characterized by a pivoting, telescoping monopod featuring multiple cylinders or tubes and designed to rest in an essentially parallel relationship to and beneath the firearm barrel forward of the forestock when not in use, and in a deployed configuration, is pivoted downwardly, typically to a position at essentially 90° with respect to the barrel, with the tubes or cylinders extended downwardly from a base tube in temporarily locked position to provide a steady rest for aiming and firing the firearm.

Yet another object of this invention is to provide a new and improved, light-weight gun rest which is characterized by a telescoping monopod featuring a base tube and multiple, tapered interior tubes, which monopod is pivotally mounted on a clamp capable of being removably and rotatably clamped to or mounted on the gun barrel of a firearm forward of the forestock to permit rapid downward pivoting of the monopod and extension and locking of the tapered, multiple, concentric tubes from the base tube in the monopod by means of grommets attached to the tubes, to a selected height in order to provide a rest for secure aiming and shooting of the firearm.

SUMMARY OF THE INVENTION

These and other objects of the invention are provided in a new and improved gun rest for firearms, which rest is characterized by a monopod pivotally mounted to a mount bracket or clamp, which clamp is in turn removably and rotatably mounted to the barrel of a gun or rifle, the monopod being further characterized by a plurality of nesting, concentrically-mounted tubes or cylinders provided in a normally retracted relationship inside a base tube and adapted for selective extension and temporarily locking downwardly of the gun barrel when the base tube is pivoted downwardly on the mount bracket for support of the barrel during aiming and firing of the firearm. In a preferred embodiment of the invention the base tube and concentrically-mounted tubes are tapered and are each provided with a grommet to aid in maintaining the tubes in a selective extended and retracted configuration.

BRIEF DESCRIPTION OF THE DRAWING

The invention will be better understood by reference to the accompanying drawings, wherein:

FIG. 1 is a side elevation of a preferred embodiment of the gun rest of this invention, with the monopod in its normally retracted configuration;

FIG. 2 is a sectional view of the gun rest monopod taken along lines 2—2 in FIG. 1;

FIG. 3 is a side elevation of the gun rest illustrated in FIG. 1 with the monopod in its deployed, extended and locked configuration as a rest to steady a firearm;

FIG. 4 is a sectional view of two of the extended cooperating, tapered cylinders or tubes forming the monopod;

FIG. 5 is a front elevation of a monopod clamp designed to pivotally attach the monopod to the barrel of a firearm;

FIG. 6 is an exploded view of the monopod and clamp illustrated in FIG. 1;

FIG. 7 is a side elevation of yet another preferred embodiment of the invention with the monopod in its retracted configuration;

FIG. 8 is a sectional view of the gun rest monopod taken along lines 8—8 in FIG. 7;

FIG. 9 is a sectional view of two of the extended, cooperating tubes shaping the monopod; and FIG. 10 is a side elevation of the gun rest with the monopod in its extended, functional configuration.

DESCRIPTION OF THE PREFERRED EMBODIMENTS

Referring now to FIGS. 1 and 4 of the drawings, in a preferred embodiment, the gun rest of this invention is generally illustrated by reference numeral 1, and includes a generally cylindrically-shaped monopod 2, which is characterized by a base tube 3, having multiple interior tubes 4, each concentrically positioned therein. A rest tube 5 is also concentrically and telescopically positioned inside the bottom one of interior tubes 4. The top end 7 of base tube 3 of monopod 2 is tightly inserted in a tube collar 6, and the bottom end 8 of base tube 3 is provided with a base tube grommet 9, which is more particularly illustrated in FIG. 4. Base tube grommet 9 serves the dual function of first sealing the interface between the outside surface of the outside one of interior tubes 4 and the inside surface of base tube 3 to prevent dust and debris from interfering with the telescoping action of the top one of interior tubes 4 inside base tube 3. The base tube grommet 9 also applies pressure on the outside surface of interior tubes 4 to aid in the positioning of interior tubes 4 successively inside base tube 3 when the interior tubes 4 are retracted and inserted in base tube 3. Similarly, and referring again to FIG. 1 of the drawings, interior tube grommets 10 are provided on the bottom end of each of the successive interior tubes 4 for the same purpose as base tube grommet 9, and a boot 11 is inserted on the bottom end of rest tube 5 to provide a point of contact with the ground or other supporting surface when monopod 2 is extended.

The tube collar 6, carrying the base tube 3 of monopod 2, is pivotally attached to a monopod bracket 15 by means of a monopod bolt 22 as illustrated in FIG. 1, and monopod 2 can therefore be pivoted in a 180° arc from the position illustrated in FIG. 1 downwardly, and finally rearwardly under the forestock 33 of the gun barrel 32.

Referring now to FIGS. 3, 5 and 6 of the drawings, in a preferred embodiment of the invention, and referring initially to FIG. 5, the monopod bracket 15 is shaped to include a rounded barrel sleeve 16 for registration with the gun barrel 32 of a firearm, and a sleeve slot 17, and slightly wider tube collar slot 18 to facilitate fitting of monopod bracket 15 over the gun barrel 32. It will be appreciated that bracket legs 20, defined by sleeve slot 17 and tube collar slot 18, are somewhat flexible. Accordingly, when barrel slot bolt 21 and monopod bolt 22 are removed from monopod bracket 15 as illustrated in FIG. 6 of the drawings, bracket legs 20 can be slipped over gun barrel 32 and barrel sleeve bolt 21 can be inserted in top bracket aperture 23 in bracket legs 20, and monopod bracket 15 can be tightly, or rotatably as the case may require, secured to gun barrel 32. When monopod bracket 15 is so mounted on gun barrel 32, tube collar 6, carrying monopod 2, is inserted in tube collar slot 18 to the point where the top of tube collar 6 abuts slot shoulders 19 in tube collar slot 18. Bracket aperture 14 in tube collar 6 is then aligned with bottom bracket apertures 24 in bracket legs 20 to permit registration of monopod bolt 22 with bottom bracket apertures 24 and bracket aperture 14, in order to pivotally secure tube collar 6 and monopod 2 onto monopod bracket 15. In another preferred embodiment of the invention tube collar 6 is provided with an air escape aperture 13 to permit the top end 7 of base tube 3 to tightly fit inside tube collar 6 and allow removal of the base tube 3 from tube collar 6 while tube collar 6 is pivotally mounted on monopod bracket 15. In another preferred embodiment of the invention monopod bolt 22 is secured in position by means of a nut 26, which is counter-sunk into the surface of tube collar 6 to eliminate projection of either the nut 26 or the end of monopod bolt 22 from the surface of tube collar 6.

Referring now specifically to FIGS. 2 and 4 of the drawings, in another preferred embodiment of the invention each of the base tube 3, interior tubes 4, and the rest tube 5 are tapered as illustrated to facilitate tight, yet releasable contact between the upper outside surface and the lower inside surfaces of the concentric tubes. In this manner the interior tubes 4 and rest tube 5 can telescope to a retracted configuration as shown in FIG. 2, yet one or more of the tubes can be extended as desired and maintained in the extended position by friction between the respective outside surface of the extended tube and the inside surface of the cooperating containing tube, aided by the friction developed by base tube grommet 9 and interior tube grommets 10, as is particularly illustrated in FIG. 4. Accordingly, one or more of the interior tubes 4 and the rest tube 5 can be extended from base tube 3 as desired, depending upon the specific rest position desired by the shooter.

Referring now to FIGS. 7–10 of the drawings, in another preferred embodiment of the invention the monopod 2 is characterized by a base tube 3 which is generally cylindrical in shape, with cooperating concentrically positioned interior tubes 4 and a rest tube 5 which are likewise cylindrical in shape and are formed of successively smaller diameters, so as to permit a concentric retraction inside base tube 3 as illustrated in FIG. 7. The monopod 2 is further provided with compression fittings 28 at the bottom end 8 of base tube 3 and at the base of each of the interior tubes 4 and the rest tube 5, as illustrated. Compression fittings 28 are provided with internal threads 29, and mate with the threaded bottom end 8 of base tube 3, and with similar threads provided at the base of interior tubes 4 and rest tube 5, respectively, as is more particularly illustrated in FIGS. 8 and 9. Furthermore, in yet another preferred embodiment of the invention compression rings 30 are provided inside compression fittings 28 in order to permit interior tube 4 to be fully extended or partially extended from base tube 3, and rest tube 5 in turn to be fully or partially extended from the interior of interior tubes 4 and compression fittings 28 to be tightened on base tube 3 and interior tubes 4 against compression rings 30 to secure interior tubes 4 and rest tube 5 in a selectively extended position, as illustrated in FIG. 10. It will be appreciated that both interior tube 4 and rest tube 5 or either of them can be extended to the desired degree by simply loosening compression fittings 28 on compression rings 30 extending interior tube 4 and/or rest tube 5, and subsequently tightening compression fittings 28 to maintain the desired extension.

It will be appreciated by those skilled in the art that both the tapered embodiment of monopod 2 as illustrated in FIGS. 1–6 of the drawings, and the cylindrical embodiment illustrated in FIGS. 7–10, provide a distinct advantage in steadying a rifle or firearm for improving aim and accuracy, and in addition, also serve to reduce recoil against the gunner's shoulder. This latter feature is particularly advantageous under circumstances where the rifle in use fires a heavy bullet and recoil is high. The advantage permits the gunner to more quickly align his sights with the intended target for faster follow-up shot or shots.

Furthermore, it will also be appreciated that the monopod gun rest in both of its major design embodiments is capable of being used by gunners positioned on the ground or in stands located above the ground level, such as in tree stands. Accordingly, referring again to the drawings, the extension of the interior tubes 4 and rest tube 5 can be effected to the extent desired while in substantially any shooting position, with the boot 11 positioned against a tree limb, the body, or a part of the stand, whichever function serves to steady the firearm in the most advantageous manner.

Having described my invention with the particularity set forth above, what is claimed is:

1. A gun rest for supporting a firearm comprising:

(a) a monopod characterized by a round, hollow and elongated base support member having a pivoted end and an open end opposite said pivoted end, and tapered from a top base support diameter at said pivoted end to a smaller bottom base support diameter at said open end, and a plurality of round, hollow and elongated interior support members carried by said base member and tapered from a first interior support diameter at the top ends thereof, respectively, to a smaller second interior support diameter at the bottom ends, thereof, respectively, to permit said interior support members to successively rest in, and selectively telescope from said open end of said base support member; and (b) a monopod bracket pivotally attached to said pivoted end of said monopod and further comprising clamp means carried by said bracket for removable engagement with the barrel of said firearm to secure said monopod bracket and said monopod to said firearm.

2. A gun rest for supporting a firearm comprising:

(a) a monopod characterized by a round, hollow and elongated base support member having a pivoted end and an open end opposite said pivoted end, and tapered from a top base support diameter at said pivoted end to a smaller bottom base support diameter at said open end, and a plurality of round, hollow and elongated interior support members carried by said base support member and tapered from a first interior support diameter at the top ends thereof, respectively, to a smaller second interior support diameter at the bottom ends thereof, respectively, to permit said interior support members to successively rest in and selectively telescope from said open end of said base support member; and (b) a monopod bracket characterized by a pair of bracket legs pivotally attached to said pivoted end of said monopod and a cooperating barrel sleeve in said bracket legs for receiving a barrel to secure said monopod bracket and said monopod to the firearm.

3. A gun rest for supporting a firearm comprising:

(a) a monopod characterized by a round, hollow, and elongated base support member having a pivoted end and an open end opposite said pivoted end, and tapered from a top base support diameter at said pivoted end to a smaller bottom base support diameter at said open end, and a plurality of round, hollow and elongated interior support members carried by said base support member and tapered from a first interior support diameter at the top ends thereof, respectively, to a smaller second interior support diameter at the bottom ends thereof, respectively, to permit said interior support members to successively rest in, and selectively telescope from said open end of said base support member;

(b) a monopod bracket pivotally attached to said pivoted end of said monopod and further comprising clamp means carried by said bracket for removable engagement with the barrel of said firearm to secure said monopod bracket and said monopod bracket and said monopod to said firearm; and (c) a grommet on said open end of said base support member and on each of said bottom ends of said interior support members to aid in maintaining said interior support members in successive retracted configuration inside said base support member.

4. A gun rest for supporting a firearm comprising:

(a) a monopod characterized by a round, hollow and elongated base support member having a pivoted end and an open end opposite said pivoted end, and tapered from a top base support diameter at said pivoted end to a smaller bottom base support diameter at said open end, and a plurality of round, hollow and elongated interior support members carried by said base support member and tapered from a first interior support diameter at the top ends thereof, respectively, to a smaller second interior support diameter at the bottom ends, thereof, respectively, to permit said interior support members to successively rest in, and selectively telescope from said open end of said base support member;

(b) a monopod bracket characterized by a pair of bracket legs pivotally attached to said pivoted end of said monopod and a cooperating barrel sleeve in said bracket legs for receiving a barrel to secure said monopod bracket and said monopod to the firearm; and (c) a grommet on said open end of said base support member and on each of said bottom ends of said interior support members to aid in maintaining said interior support members in successive retracted configuration inside said base support member.

5. A gun rest for mounting on the barrel of a firearm and steadying the firearm comprising:

(a) a monopod having a round, hollow base support member which tapers from a top base support diameter at a closed, top end to a smaller bottom base support diameter at an open end opposite said top end, and a plurality of round, hollow interior support members normally positioned in retracted configuration partially inside said base support member, each of said interior support members successively tapering from a top interior support diameter to a smaller bottom interior support diameter, with said top interior support diameter of the largest of said interior support members being larger than said bottom base support diameter of said base support member, and the top interior support diameters of each successive one of said interior support members, respectively, being larger than the corresponding bottom interior support diameter of the next largest and cooperating one of said interior support members, respectively, to facilitate extension of said interior support members from said base support member to form an essentially rigid firearm support monopod; and (b) a monopod bracket removably fitted to said barrel and having a pair of legs extending in generally parallel relationship downwardly from said barrel and pivotally attached to said top end of said monopod.

6. The gun rest of claim 5 further comprising clamp means cooperating with said monopod bracket for rotatably securing said monopod bracket to said barrel.

7. The gun rest of claim 6 wherein said clamp means is a barrel sleeve bolt extending through said legs for tightening said monopod bracket on said barrel, and further comprising a monopod bolt extending through said legs beneath, and in spaced relationship to said barrel sleeve bolt, and further extending through said top end of said base support to pivotally secure said monopod to said monopod bracket.

8. The gun rest of claim 7 further comprising collar means fitted over said top end of said base support to close said top end of said base support.

* * * * *